US009683733B2

(12) United States Patent
Brodeβer et al.

(10) Patent No.: US 9,683,733 B2
(45) Date of Patent: Jun. 20, 2017

(54) METHOD FOR OPERATING A STEAM GENERATOR

(75) Inventors: Joachim Brodeβer, Nürnberg (DE); Jan Brückner, Uttenreuth (DE); Martin Effert, Erlangen (DE)

(73) Assignee: SIEMENS AKTIENGESELLSCHAFT, München (DE)

( * ) Notice: Subject to any disclaimer, the term of this patent is extended or adjusted under 35 U.S.C. 154(b) by 498 days.

(21) Appl. No.: 13/695,656

(22) PCT Filed: Apr. 7, 2011

(86) PCT No.: PCT/EP2011/055401

§ 371 (c)(1),
(2), (4) Date: Nov. 1, 2012

(87) PCT Pub. No.: WO2011/138116

PCT Pub. Date: Nov. 10, 2011

(65) Prior Publication Data

US 2013/0047938 A1 Feb. 28, 2013

(30) Foreign Application Priority Data

May 7, 2010 (DE) ..... 10 2010 028 720

(51) Int. Cl.

| | |
|---|---|
| ***F22B 37/00*** | (2006.01) |
| ***F22B 29/00*** | (2006.01) |
| ***F22B 35/10*** | (2006.01) |
| ***F22D 5/36*** | (2006.01) |

(52) U.S. Cl.
CPC ..... *F22B 29/00* (2013.01); *F22B 35/10* (2013.01); *F22D 5/36* (2013.01)

(58) Field of Classification Search
USPC ..... 432/138, 195; 414/160, 162, 586–588; 122/7 R, 4 D
See application file for complete search history.

(56) References Cited

U.S. PATENT DOCUMENTS

| | | | | |
|---|---|---|---|---|
| 3,262,431 | A * | 7/1966 | Hanzalek | F01K 3/22 122/406.5 |
| 5,293,842 | A | 3/1994 | Loesel | |
| 6,152,085 | A * | 11/2000 | Dethier et al. | 122/235.29 |
| 6,173,679 | B1 * | 1/2001 | Bruckner et al. | 122/406.4 |
| 6,460,490 | B1 * | 10/2002 | Knauss | 122/7 R |
| 7,243,618 | B2 * | 7/2007 | Gurevich | 122/7 R |

(Continued)

FOREIGN PATENT DOCUMENTS

| | | |
|---|---|---|
| CN | 1888531 A | 1/2007 |
| CN | 1948831 A | 4/2007 |

(Continued)

*Primary Examiner* — Alissa Tompkins
*Assistant Examiner* — John Bargero

(57) ABSTRACT

A method for operating a steam generator comprising a combustion chamber having a plurality of evaporator heating surfaces which are connected in parallel on the flow medium side is provided. An object is to provide a steam generator which has a particularly long service life and which is particularly reliable. For this purpose, a flow medium is introduced into an inlet of a first evaporator heating surface at a temperature which is lower than the temperature of the flow medium introduced into the inlet of a second evaporator heating surface.

9 Claims, 4 Drawing Sheets

(56) References Cited

U.S. PATENT DOCUMENTS

| | | | | |
|---|---|---|---|---|
| 2001/0025609 | A1* | 10/2001 | Liebig | F22D 1/12<br>122/406.1 |
| 2010/0089024 | A1 | 4/2010 | Brueckner | |

FOREIGN PATENT DOCUMENTS

| | | | |
|---|---|---|---|
| CN | 200940824 | Y | 8/2007 |
| DE | 1104523 | B | 4/1961 |
| DE | 19651678 | A1 | 6/1998 |
| DE | 10354136 | A1 | 6/2004 |
| EP | 0308726 | A1 | 3/1989 |
| EP | 0359735 | A1 | 3/1990 |
| JP | 2003214601 | A | 7/2003 |
| WO | WO 2007133071 | A2 | 11/2007 |

* cited by examiner

METHOD FOR OPERATING A STEAM GENERATOR

CROSS REFERENCE TO RELATED APPLICATIONS

This application is the US National Stage of International Application No. PCT/EP2011/055401, filed Apr. 7, 2011 and claims the benefit thereof. The International application claims the benefits of German application No. 10 2010 028 720.2 DE filed May 7, 2010. All of the applications are incorporated by reference herein in their entirety.

FIELD OF INVENTION

The invention relates to a method for operating a steam generator with a combustion chamber having a plurality of evaporator heating surfaces which are connected in a parallel manner on the flow medium side. It also relates to such a steam generator.

BACKGROUND OF INVENTION

A steam generator is a closed, heated vessel or a pressure tube system, which serves the purpose of generating steam of high pressure and high temperature for heating and operating purposes (e.g. to operate a steam turbine). Where there are particularly high steam outputs and pressures, as for example when generating energy in power plants, water tube boilers are used, in which the flow medium—usually water—is present in steam generator tubes. Water tube boilers are also used for the combustion of solid matter, as the combustion chamber in which heat is generated by the combustion of the respective solid matter can be embodied as required by the arrangement of tube walls.

Such a steam generator with the structure of a water tube boiler therefore comprises a combustion chamber, the enclosing wall of which is formed at least partially from tube walls, in other words steam generator tubes welded in a gas-tight manner. On the flow medium side these steam generator tubes first act in the manner of evaporator heating surfaces to form an evaporator, in which unevaporated medium is introduced and evaporated. The evaporator here is usually disposed in the hottest region of the combustion chamber. Connected downstream of it on the flow medium side, if required, are a facility for separating water and steam and a superheater, in which the steam is heated further beyond its evaporation temperature in order to achieve a high degree of efficiency in a subsequent heat engine, as for example during expansion in a steam turbine. A preheater (or economizer) can be connected upstream of the evaporator on the flow medium side, to preheat the supply water using waste heat or residual heat and thus also to increase the efficiency of the plant as a whole.

Depending on the structure and geometry of the steam generator, further steam generator tubes can be disposed within the combustion chamber, being connected parallel to the steam generator tubes forming the enclosing walls on the flow medium side. They can be joined or welded together for example to form an inner wall. Depending on the desired arrangement of evaporator heating surfaces or inner walls within the combustion chamber, it may be necessary to interleave inner walls one behind the other on the flow medium side and to connect their steam generator tubes by way of an intermediate collector.

This is the case for example with the so-called pant-leg design for steam generators with fluidized bed combustion.

With these two inner walls formed at least partially from further steam generator tubes and disposed symmetrically in the combustion chamber are connected upstream of an intermediate collector on the flow medium side. The medium flow from the upstream inner wall combines in the intermediate collector and it serves as an inlet collector for a downstream inner wall. The pant-leg design provides better mixing of the fuel mixture and therefore fewer possible distribution problems on the combustion side.

However in certain operating states a steam content greater than zero can already result in the intermediate collector. Such a steam content renders impossible a regular distribution of the medium to the downstream inner wall with a simple collector, so that water/steam separation can occur. Individual tubes of the downstream inner wall can thus have such high steam contents or enthalpies at their inlet that superheating of said tubes is very likely. Such superheating can cause tube damage during longer-term operation.

SUMMARY OF INVENTION

The object of the invention is therefore to specify a method for operating a steam generator of the type mentioned above and a steam generator, which allow the steam generator to have a particularly long service life and particularly little need for repair.

According to the invention this object is achieved by supplying flow medium to an inlet of a first evaporator heating surface at a lower temperature than to an inlet of a second evaporator heating surface.

The invention is based on the consideration that a particularly long service life and particularly little need for repair could be achieved for an evaporator in a steam generator, by preventing superheating of the steam generator tubes due to excessively high steam contents or enthalpies. Such high steam contents occur here in particular because already partially evaporated flow medium is distributed in an irregular manner to the downstream steam generator tubes when collectors are connected in an intermediate manner. Such irregular distribution should therefore be prevented by avoiding two-phase mixing of water and steam in the intermediate collector. This could be achieved, if the inner walls upstream of the intermediate collector did not feature tubes, so that the medium subcools and enters the intermediate collector without further preheating. However this solution has structural disadvantages. Therefore the temperature of the flow medium should be reduced at the inlet into the steam generator instead.

However reducing the inlet temperature of the flow medium makes the steam process less efficient and this is not desirable. Also such a reduction is not necessary in steam generator tubes that are heated less or in tube walls without intermediate collectors—in particular in the enclosing walls of the steam generator. To improve efficiency therefore, the inlet temperature should not be reduced in such steam generator tubes.

This can be achieved by supplying flow medium to evaporator heating surfaces with downstream intermediate collectors—e.g. the inner walls in the case of the pant-leg design—at a lower temperature than to other evaporator heating surfaces.

To improve efficiency and to optimize the heating surface arrangement, a preheater is advantageously connected upstream of the inlets of the enclosing walls and the inner walls of a steam generator. This uses waste heat to preheat the flow medium. The lower waste gas temperature produced when waste heat is used makes the steam generator more efficient. The steam generator can have a particularly simple structure, as the different temperature at the inner wall and enclosing wall of the steam generator is achieved by structural measures at the preheating facility, in other words by supplying mediums with a different degree of preheating. To this end a first part of the flow medium is advantageously conducted past the preheater. This can be done using a bypass line. It is thus possible to bypass the preheater of the preheating facility in a structurally simple manner, so that less heat is input into the bypassed part of the flow medium. This can then be supplied to the inlet of the first evaporator heating surface at a lower temperature.

In order to achieve a temperature that is not excessively reduced in the evaporator heating surfaces subjected to cooler flow medium, the first part of the flow medium should advantageously be mixed with a second part that is branched after the preheater on the flow medium side. A particularly tailored reduction of the temperature of the flow medium supplied to the first evaporator heating surface is thus achieved.

The mass throughflow of the second part-flow advantageously has an upper limit here. This limit can be applied by way of a manual regulating or control valve for setting a quantity limit for the second control flow. A direction-based limit should also be provided by a non-return valve in order not to cool the main flow of the preheater outlet flow, from which the second part-flow is branched, in an undesirable manner.

In order to achieve particularly simple tailoring of the temperature of the flow medium supplied to the first evaporator heating surface, the mass throughflow of the first part-flow should advantageously be regulated based on thermodynamic characteristics at a measurement point downstream of the inlet of the first evaporator heating surface. A regulating valve can be disposed in the bypass line of the preheater for this purpose. If the plant is operated at supercritical pressures, at which water and steam cannot occur simultaneously at any temperature and therefore phase separation is also not possible, there is no risk of the separation described above and the part of the flow medium conducted past the preheater can be reduced to zero. If the steam generator is operated at subcritical pressures in the evaporator, as for example during partial load operating mode of a modern variable pressure boiler, a certain level of subcooling must be observed to prevent the separation of the two mediums, this being determined using thermodynamic characteristics at a measurement point behind the first evaporator heating surface.

In order, with the pant-leg design steam generators described above, to achieve a particularly targeted consideration of the thermodynamic states in the intermediate collector of the inner wall, where the problem of the separation of steam and water components leads to irregular distribution to the following tubes, the measurement point here should advantageously be disposed in an intermediate collector connected downstream of the first evaporator heating surface.

In an advantageous embodiment the thermodynamic characteristic is considered in such a manner that pressure and temperature are used as thermodynamic characteristics, with the saturated steam temperature being determined from the measured pressure and the actual subcooling value being determined based on the measured temperature. Subcooling can thus be determined directly as a decisive variable for the problems under discussion.

For particularly simple regulation a setpoint value is advantageously predefined for subcooling and the mass throughflow of the first part-flow is regulated based on the deviation between the actual and setpoint values for subcooling. If the actual value for subcooling is lower than the setpoint value, the mass throughflow of the first part-flow is advantageously increased. Thus if subcooling is inadequate, the regulating valve in the part-flow removed before the preheater is opened again, so that the temperature of the flow medium supplied to the inlets is reduced and therefore subcooling is increased. If subcooling is excessive, the regulating valve is closed.

As the load of the steam generator falls or rises, more or less flow medium is supplied to the evaporator by way of the main supply water regulating circuit. The components of the flow medium mass flow supplied to the different parallel evaporator heating surfaces remain almost constant over the load. It is therefore possible to calculate a setpoint value for the mass flow for the first evaporator heating surface using design calculations. In order to achieve particularly precise mass flow regulation for the evaporator heating surfaces to be subjected to colder flow medium, the mass throughflow of the second part-flow is advantageously regulated based on the mass throughflow of the flow medium supplied to the first evaporator heating surface.

A further regulation of the mass throughflow of the flow medium supplied to the first evaporator heating surface can take place taking into account a water/steam separation facility downstream of the evaporator heating surfaces. In an advantageous embodiment the flow of the medium supplied to the first evaporator heating surface is regulated based on the outlet enthalpy of the evaporator.

The outlet enthalpy here is advantageously determined based on the temperature of the flow medium at the last evaporator heating surface connected downstream of the first evaporator heating surface on the flow medium side and the pressure in the water/steam separation facility. Regulation of the outlet enthalpy to the mean fluid enthalpy in the separator is favorable here. The setpoint value of the evaporator outlet enthalpy should be stored here as a function of load in the main regulating circuit. In any case the outlet temperature of the fluid should be limited so that the maximum permissible material temperature is not exceeded.

The advantages achieved with the invention consist in particular of the fact that using two mediums with different levels of subcooling to supply the different evaporator parts (enclosing walls and inner walls) means that the problem of water/steam separation in the intermediate collector is reliably avoided. In contrast to a solution with reduced inlet enthalpy for all evaporator parts, the evaporator does not have to be enlarged or only has to be enlarged slightly to ensure a sufficiently high outlet enthalpy at the evaporator.

An embodiment of the steam generator as a forced-circulation boiler has a number of advantages. Forced-circulation steam generators can be used both for subcritical and for supercritical pressure without changing the method technology. Only the wall thicknesses of the tubes and collectors have to be dimensioned for the specified pressure. The circulation principle is therefore part of a trend identified throughout the world for increasing efficiency by enhancing the steam states.

Operation of the plant as a whole with variable pressure is also possible. In variable pressure mode temperatures in the high-pressure part of the turbine remain constant over the entire load range. The large dimensions in respect of the diameter and wall thickness of the component mean that the turbine is subject to a much greater load than the boiler components. Variable pressure mode therefore has advantages in respect of load change speeds, number of load changes and starts.

BRIEF DESCRIPTION OF THE DRAWINGS

An exemplary embodiment of the invention is described in more detail below with reference to a drawing, in which.

Identical parts are shown with the same reference characters in all the figures.

DETAILED DESCRIPTION OF INVENTION

Figure 1:
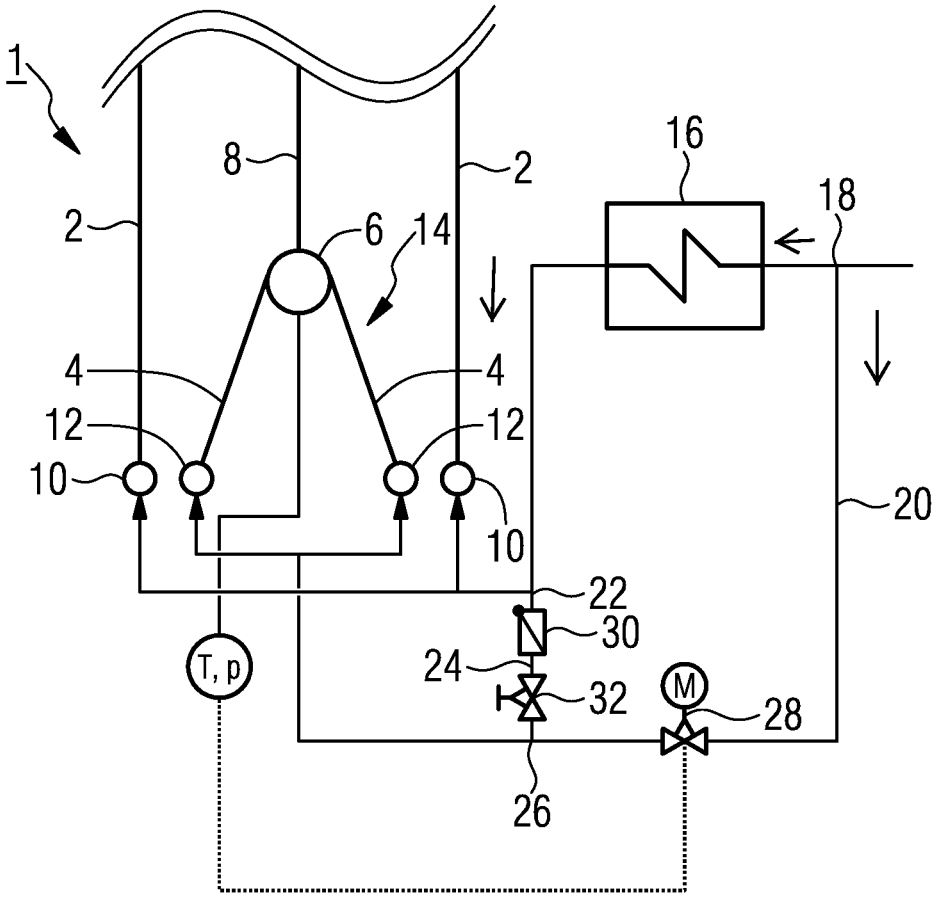
FIG. 1 shows a schematic diagram of the lower part of the combustion chamber of a forced-circulation steam generator with fluidized bed combustion with a partially bypassed preheating facility.

The steam generator 1 illustrated schematically in FIG. 1 is embodied as a forced-circulation steam generator. It comprises a number of tube walls, which are formed from steam generator tubes and contain an upward flow, specifically an enclosing wall 2 and symmetrically disposed, angled inner walls 4, connected downstream of which by way of an intermediate collector 6 on the flow medium side is a further inner wall 8. The circulation steam generator 1 is thus embodied with the so-called pant-leg design.

Flow medium passes through the inlets 10, 12 assigned respectively to the enclosing wall 2 and inner walls 4 into the tube walls. In the interior 4 a solid fuel is combusted in the manner of fluidized bed combustion, as a result of which heat is input into the tube walls, bringing about heating and evaporation of the flow medium. If the medium enters all the tube walls with the same enthalpy, the steam content in the intermediate collector 6 can be so high that there is irregular distribution to the tubes of the inner wall 8 with the result that the tubes with a high steam content superheat.

To avoid the disadvantages that would result, such as for example a shorter service life or a greater need for repair, flow medium is supplied to the inner walls 4 upstream of the intermediate collector 6 at a lower temperature than to the enclosing wall 2. Provision is therefore made first in the steam generator 1 for modifications to the preheater 16, which ensure different heat inputs into the different medium flows.

To this end a branch point 18 is provided upstream of the preheater 16 on the flow medium side according to FIG. 1. A part of the flow medium is thus directed around the preheater 16 in a bypass line 20. A further branch point 22 is initially provided downstream of the preheater 16 in a flow medium side direction, with a line passing from it to the inlets 10 of the enclosing wall 2. A part of the preheated flow medium is thus supplied to the enclosing wall 2. Another part of the preheated flow medium is conveyed in a line 24, which meets the bypass line 20 at a mixing point 26. The mixing of the medium flows here produces a medium at lower temperature, which is then supplied to the inlets 12 of the inner walls 4.

An non-return valve 30 is disposed in the line 24, to prevent undesirable cooling by a return flow into the branch point 22. A manual throughflow regulating valve 32 is also provided, which limits the branched mass flow of preheated medium upward. An automatic throughflow regulating valve 28 in the bypass line 20 allows the quantity of bypassed flow medium and therefore the temperature of the flow medium supplied to the inner walls 4 to be easily regulated.

Pressure p and temperature T in the intermediate collector 6 are used as input variables for automatic regulation in the throughflow regulating valve 28. The saturated steam temperature is first determined from the determined pressure, its difference in respect of the determined temperature T giving the actual subcooling. In order to prevent separation of water and steam in the intermediate collector 6, a setpoint subcooling in the intermediate collector 6 is predefined. If the actual subcooling is below the setpoint subcooling, the automatic throughflow regulating valve 28 is closed further so that the temperature at the inlets 12 rises. Conversely the throughflow regulating valve 28 is opened further. If pressure and temperature are above the critical point of the flow medium, the throughflow regulating valve 28 is closed completely, since at supercritical pressures water and steam cannot occur simultaneously at any temperature and therefore separation can no longer occur in the intermediate collector 6.

Figure 2:
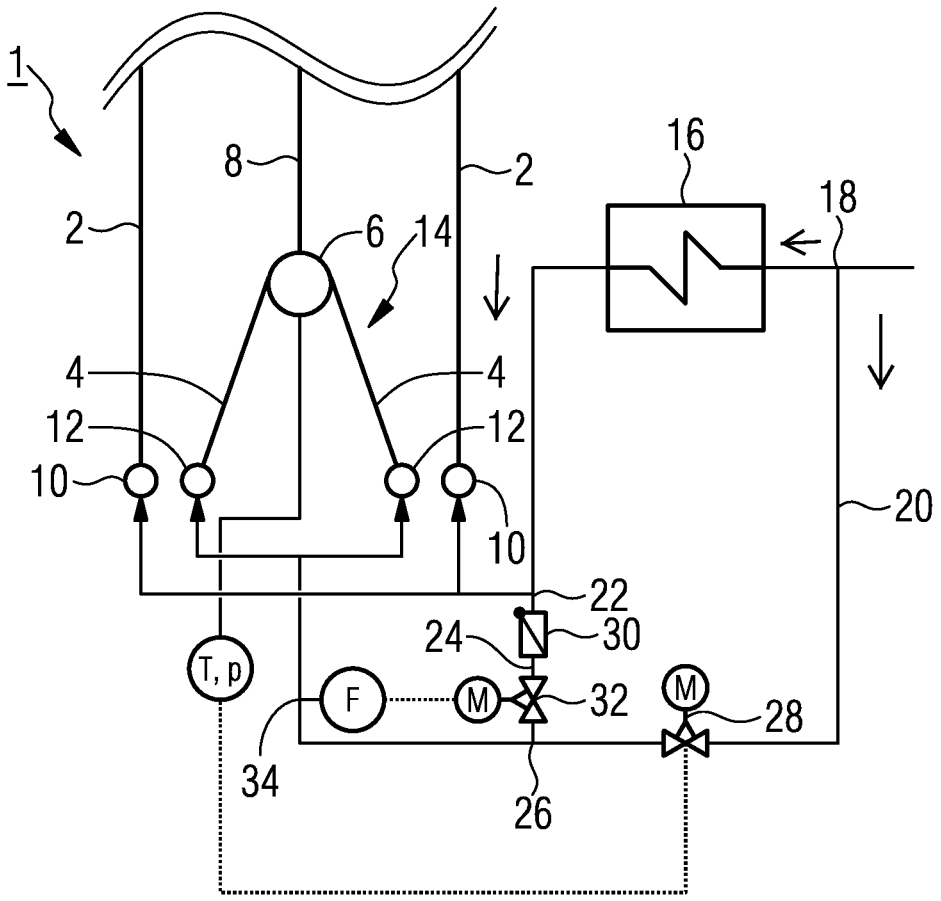
FIG. 2 shows the circulation steam generator from FIG. 1 with regulation of the throughflow to the inner walls.

FIG. 2 shows an alternative embodiment of the invention. The steam generator 1 here is identical to FIG. 1 apart from the throughflow regulating valve 32. The throughflow regulating valve 32 here is automated like the regulating valve 28. This also allows the quantity of medium supplied to the inner walls 4 to be regulated. The input variable for regulation here is the overall flow F to the inlets 12, which is determined at a measurement point 34. The overall flow F here is conveyed based on a setpoint value determined by means of design calculations.

Figure 3:
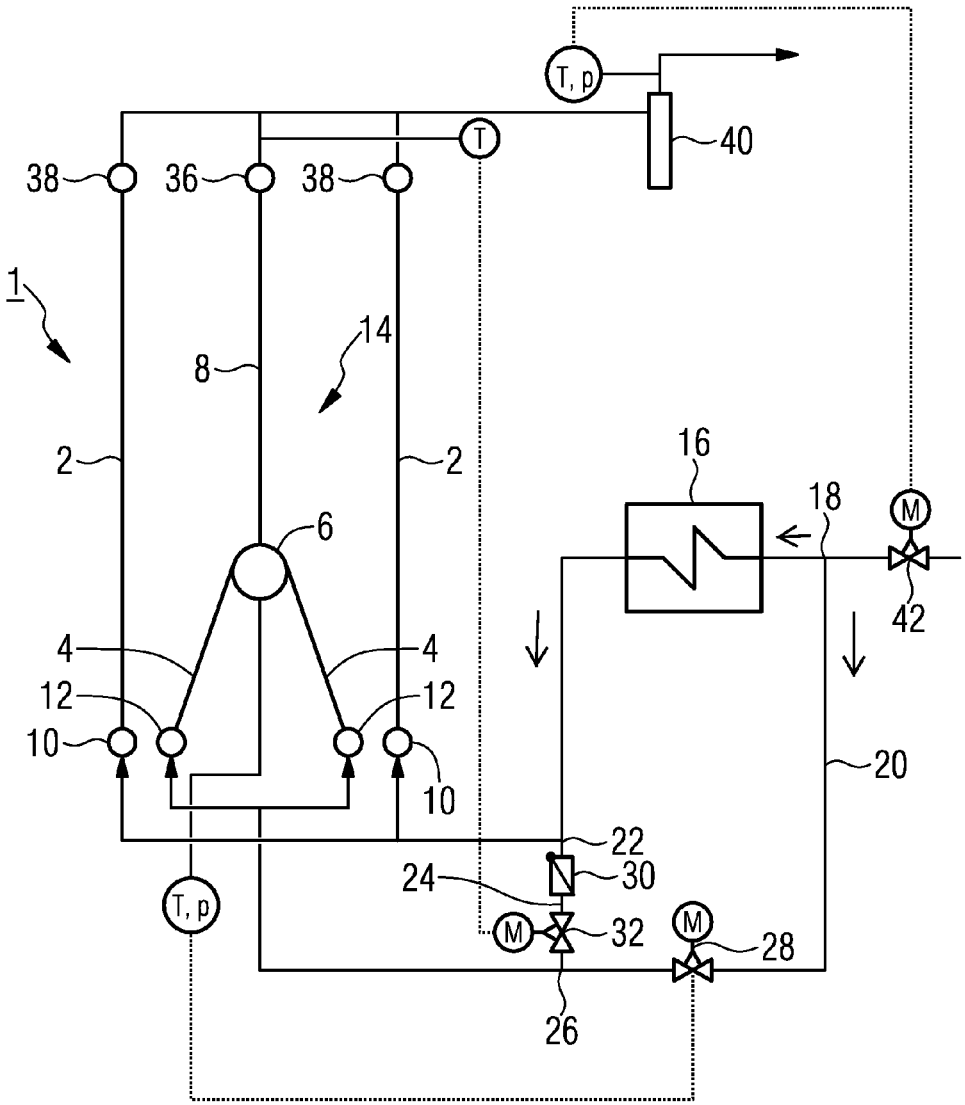
FIG. 3 shows the circulation steam generator from FIG. 1 with regulation of the outlet enthalpy of the inner walls.

A further embodiment of the invention is illustrated in FIG. 3. The steam generator 1 here is identical to FIG. 2 but further components are illustrated, specifically the outlet 36 of the inner wall 8 and the outlets 38 of the enclosing wall 2. The medium flows from the outlets 36, 38 are combined and conveyed to a water/steam separator 40. The main regulating circuit, which regulates the entire quantity of flow medium supplied to the steam generator 1 by means of a throughflow regulating valve 42, is also shown here. Pressure p and temperature T at the steam-side outlet of the water/steam separator 40 serve as input variables for regulating the overall medium flow here.

In FIG. 3 the quantity of flow medium supplied to the inner walls 4 by way of the inlets 12 is regulated as a function of the outlet enthalpy of the inner wall 8. This is determined based on the temperature T at the outlet 36 of the inner wall 8 and the pressure p in the water/steam separator 40. Provision is made here for the mean fluid enthalpy in the water/steam separator 40 to be the setpoint value for the outlet enthalpy of the inner wall 8. The outlet temperature at the outlet 40 is also limited above the maximum permissible material temperature.

Figure 4:
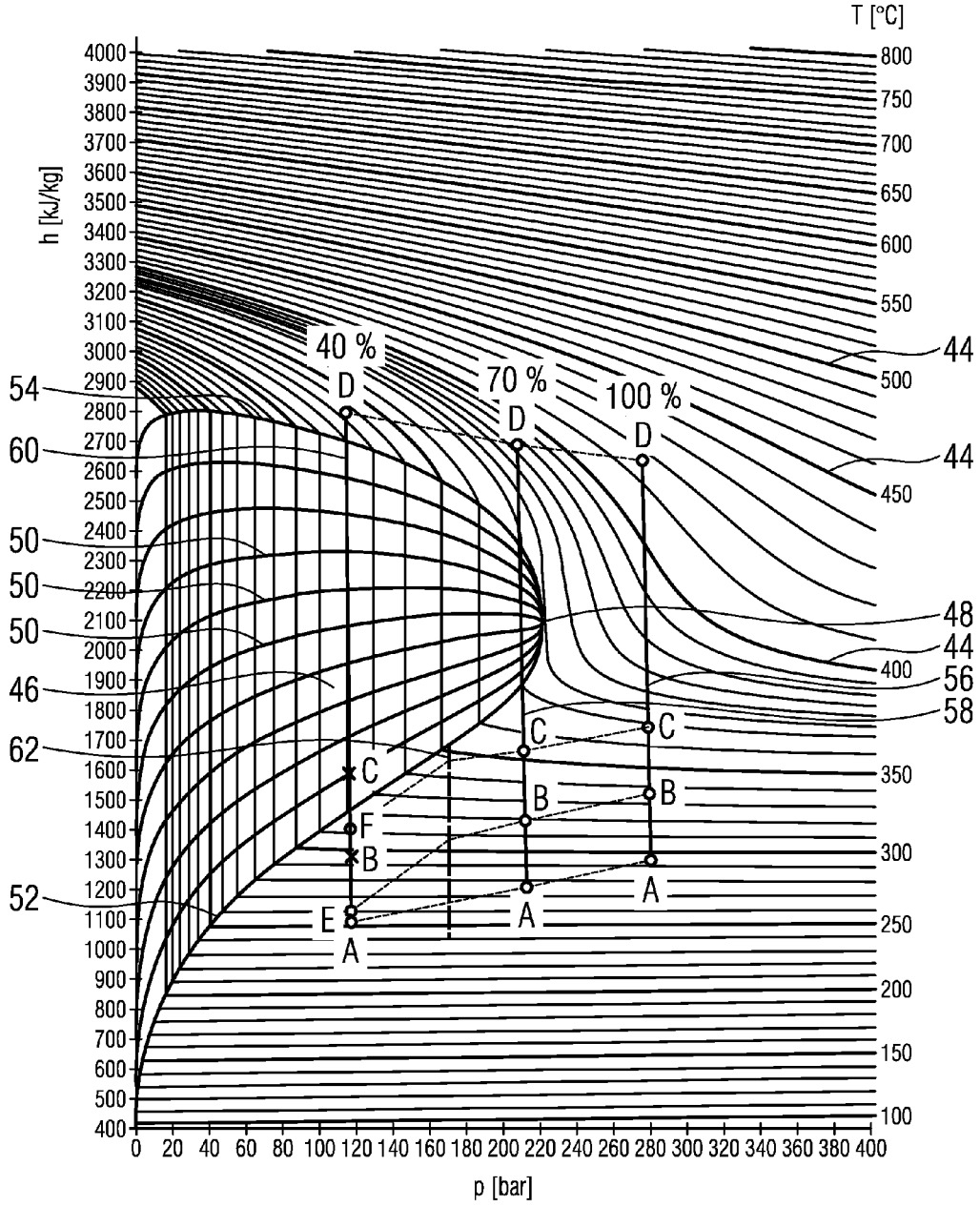
FIG. 4 shows a graph, illustrating specific enthalpy and pressure of the flow medium in different regions of the circulation steam generator with different loads.

FIG. 4 finally shows a state diagram for water/steam, in which the states of the flow medium are shown in different regions of the steam generator. The diagram shows the specific enthalpy h in kJ/kg against the pressure p in bar. Lines of identical temperature T, in other words isotherms 44, are shown first, their respective temperature values being indicated on the right axis of the graph in degrees Celsius. The bulge-like structure 46 on the left side of the graph shows the steam content of the water/steam mixture. Outside the structure 46 the medium is single-phase, in other words only medium in an aggregate state is present. The peak of the structure 46 at around 2100 kJ/kg and 221 bar here marks the critical point 48. When the pressure rises above 221 bar, water and steam do not occur simultaneously at any temperature.

A water/steam mixture is present within the structure 46. The proportion of water and steam is shown here with characteristic lines 50 at 10 percent intervals, from 0% steam content at characteristic line 52 to 100% steam content at characteristic line 54. The characteristic lines 50, 52, 54 converge here at the critical point 48. Within the structure 46 the isotherms 44 run perpendicular to the pressure axis, so they are also isobars. An energy input into the medium at constant pressure therefore does not bring about a higher temperature but rather a displacement of the water/steam component toward more steam.

Depending on the load state of the steam generator 1 the steam process within the steam generator 1 runs on different load characteristic lines 56, 58, 60, which are not isobars, as the pressure losses of the heating surfaces are shown. The load essentially determines the pressure within the system as a whole. Load characteristic line 56 represents the steam process at 100% load, load characteristic line 58 the steam process at 70% load and load characteristic line 60 the steam process at 40% load. Points A, B, C, D here respectively represent the state of the flow medium at different points of the steam generator 1, initially still without the inventive separate regulation of the temperature at the inlets 12 of the inner walls 4: point A the state at the inlet of the preheater 16, point B the state at the inlet 12 of the inner walls 4, point C the state in the intermediate collector 6 and point D the state at the outlet of the evaporator.

As shown in FIG. 4 at 100% load the steam generator is operated completely in the supercritical region. At no point A, B, C, D on the load characteristic line 56 is it possible to distinguish water and steam, so separation cannot occur. At 70% load the subcritical region has already been reached but only a small part of the load characteristic line 58 lies within the structure 46. Points A, B, C of the load characteristic line 58 are still below the structure 46 and single-phase water is present. Separation cannot occur in the intermediate collector 6 here either.

However at 40% load a significant part of the load characteristic line 60 lies within the structure 46. Points A and B on the load characteristic line 60 are still below the structure 46, so single-phase water is still present here. Point C on the load characteristic line 60 however lies within the structure 46 with a steam component of 10%. The described separation in the intermediate collector 6 can take place here. However if a part of the flow medium is conveyed past the preheater 16, which is achieved in pressure regions below the load characteristic line 62 by opening the throughflow regulating valve 28, the temperature and therefore the energy content of the flow medium are specifically reduced. On load characteristic line 60 point E then shows the state of the flow medium at the inlet 12 of the inner walls 4 with a reduced temperature. This also reduces the energy content in the intermediate collector 6, as shown by point F on load characteristic line 60. This point F is now outside the structure 46, so single-phase water is present here and separation is reliably prevented.

The invention claimed is:

1. A method for operating a steam generator with a combustion chamber having a plurality of evaporator heating surfaces which are connected in a parallel manner on the flow medium side, comprising:

forming a peripheral wall of the combustion chamber of steam generator pipes;

forming an inner wall and a further inner wall at least partly from additional steam generator pipes;

arranging the inner wall and the further inner wall inside the combustion chamber;

connecting the further inner wall downstream from the inner wall on a flow medium side by an intermediate collector;

supplying a flow medium to a first inlet of a first evaporator heating surface at a lower temperature than to a second inlet of a second evaporator heating surface, wherein a preheater is connected upstream of the first and second inlets on the flow medium side, wherein a bypass line is arranged so that a first part of the flow medium is conducted to bypass the preheater, wherein a branch point is provided upstream of the preheater on the flow medium side such that the first part originates at the branch point and bypasses the preheater, wherein the first part of the flow medium is mixed with a second part of the flow medium that is branched downstream of the preheater on the flow medium side, the mixture of the first part and the second part is supplied to the first inlet, and wherein the mass throughflow of the first part flow is regulated via a throughflow regulating valve disposed in the bypass line based on thermodynamic characteristics at a measurement point downstream of the first inlet of the first evaporator heating surface, wherein the measurement point is disposed in the intermediate collector connected downstream of the first evaporator heating surface.

2. The method as claimed in claim 1, wherein a mass throughflow of the second part flow has an upper limit.

3. The method as claimed in claim 1, wherein pressure and temperature are used as thermodynamic characteristics, with the saturated steam temperature being determined from the measured pressure and the actual subcooling value being determined based on the measured temperature.

4. The method as claimed in claim 3, wherein a setpoint value is predefined for subcooling, and wherein the mass throughflow of the first part flow is regulated based on the deviation between the actual and setpoint values for subcooling.

5. The method as claimed in claim 4, wherein when the actual value for subcooling is lower than the setpoint value, the mass throughflow of the first part flow is increased.

6. The method as claimed in claim 1, wherein the mass throughflow of the second part flow is regulated based on the mass throughflow of the flow medium supplied to the first evaporator heating surface.

7. The method as claimed in claim 1, wherein the flow of the medium supplied to the first evaporator heating surface is regulated based on the outlet enthalpy of a last evaporator heating surface connected downstream of the first evaporator heating surface on the flow medium side.

8. The method as claimed in claim 7, wherein the outlet enthalpy of the evaporator heating surface is determined based on the temperature at the outlet of the flow medium at the last evaporator heating surface connected downstream of the first evaporator heating surface on the flow medium side and the pressure in a water/steam separator connected downstream of the first, second, and last evaporator heating surfaces on the flow medium side.

9. A steam generator, comprising means for executing the method as claimed in claim 1.

* * * * *